US012146663B2

(12) United States Patent
Barry et al.

(10) Patent No.: US 12,146,663 B2
(45) Date of Patent: Nov. 19, 2024

(54) CABINET CIRCULATOR SOLID FUEL HEATER COMBUSTION SYSTEM

(71) Applicant: UNITED STATES STOVE COMPANY, South Pittsburg, TN (US)

(72) Inventors: Brandon Lane Barry, Sewanee, TN (US); Corey Brooks, Bryant, AL (US); Dustin Mantooth, Kimball, TN (US)

(73) Assignee: United States Stove Company, South Pittsburg, TN (US)

( * ) Notice: Subject to any disclaimer, the term of this patent is extended or adjusted under 35 U.S.C. 154(b) by 496 days.

(21) Appl. No.: 17/677,441

(22) Filed: Feb. 22, 2022

(65) Prior Publication Data

US 2022/0268445 A1 Aug. 25, 2022

Related U.S. Application Data

(60) Provisional application No. 63/152,182, filed on Feb. 22, 2021.

(51) Int. Cl.

| | |
|---|---|
| ***F24B 7/02*** | (2006.01) |
| ***F23L 15/00*** | (2006.01) |
| ***F24B 1/02*** | (2006.01) |
| ***F24B 5/02*** | (2006.01) |
| ***F24B 13/00*** | (2006.01) |

(52) U.S. Cl.

CPC ..... *F24B 7/025* (2013.01); *F23L 15/00* (2013.01); *F24B 1/028* (2013.01); *F24B 5/025* (2013.01); *F24B 5/028* (2013.01); *F24B 13/004* (2013.01); *F24B 13/008* (2013.01)

(58) Field of Classification Search

None

See application file for complete search history.

(56) References Cited

U.S. PATENT DOCUMENTS

| | | | | | |
|---|---|---|---|---|---|
| 4,360,000 | A * | 11/1982 | Down | F24B 7/025 | 126/77 |
| 4,582,045 | A * | 4/1986 | Dorau | F24B 1/006 | 126/286 |
| 4,832,000 | A * | 5/1989 | Lamppa | F24B 5/026 | 126/77 |
| 5,263,471 | A * | 11/1993 | Shimek | F23L 9/02 | 126/528 |
| 10,041,682 | B1 * | 8/2018 | Myers | F23L 9/02 | |
| 2018/0058724 | A1 * | 3/2018 | Haynes | F23L 9/06 | |

* cited by examiner

*Primary Examiner* — David J Laux

(74) *Attorney, Agent, or Firm* — Pitchford Fugett, PLLC; Mark A. Pitchford; Eric B. Fugett

(57) ABSTRACT

A solid fuel burning cabinet circular heating appliance achieves improved emissions performance by providing a secondary air combustion path that preheats secondary combustion air. The firebox is selectively insulated such that areas of the firebox that do not preheat combustion air retain heat in the firebox while areas of the firebox that transfer heat into the combustion air transfer heat through the firebox into the incoming combustion air. The exhaust air path from the firebox to a chimney is also uninsulated to allow relatively quick heat transfer into a room in which the appliance is installed.

19 Claims, 10 Drawing Sheets

CABINET CIRCULATOR SOLID FUEL HEATER COMBUSTION SYSTEM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to and hereby incorporates by reference in its entirety U.S. Provisional Patent Application Ser. No. 63/152,182 entitled "CABINET CIRCULATOR SOLID FUEL HEATER COMBUSTION SYSTEM" filed on Feb. 22, 2021.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to cabinet circulator solid fuel heaters. More particularly, this invention pertains to a cabinet circulator solid fuel heater combustion system.

Solid fuel burning cabinet circulator heating appliances or stoves have been a popular heating product for the past half century. These heating appliances are popular because they burn solid fuel (e.g., logs, wood pellets, coal, etc.), have a fully shielded firebox (i.e., a cabinet surrounding the firebox) which reduces burn potential, have fuel loading and ash servicing hidden behind an outer cabinet door, can cook at a high temperature on the firebox (with the cabinet top removed) or at a low temperature on top of the cabinet top, and have a thin firebox wall that heats up quickly to begin transferring heat into the space to be heated.

These cabinet circulator heaters have had little to no successful emissions controls implemented primarily due to the desire to keep a thin, light gauge firebox. Past attempts to control or reduce emissions have resulted in a complicated and awkward user interface. The complicated nature of these interfaces resulted in these heaters having less effect in improving emissions than intended because users preferred the older, simpler heaters. With the Environmental Protection Agency's (EPA) New Source Performance Standards (NSPS) becoming effective in 2020 for residential wood heaters, effective emissions controls are now required for solid fuel burning cabinet circulator heating appliances sold in the United States.

BRIEF SUMMARY OF THE INVENTION

Aspects of the present invention provide solid fuel burning cabinet circular heating appliance having improved emissions performance. A user interface of the heater is simplified and required emissions control targets are achieved. Improved performance is achieved by providing a secondary air path that preheats secondary combustion air and selectively insulating the firebox (e.g., with firebrick, ceramics, or fiberglass blankets) such that areas of the firebox that do not preheat combustion air retain heat in the firebox while areas of the firebox that transfer heat into the combustion air transfer heat through the firebox into the incoming combustion air. An exhaust air path of the firebox is also uninsulated such that the appliance begins transferring heat relatively quickly into a room in which the appliance is installed.

Aspects of the present invention are directed to a cabinet circulator solid fuel heating appliance including a firebox, a cabinet, a combustion air intake, a primary air combustion path, and a secondary air combustion path. The firebox is configured to receive solid fuel and combust the solid fuel therein. The cabinet surrounds the firebox on at least 5 sides of the firebox when the heating appliance is assembled. The combustion air intake is configured to receive combustion air at a first side of the heating appliance. The primary air combustion path is configured to receive the combustion air from the combustion air intake and direct primary combustion air forward toward a front of the heating appliance and across a front of the firebox from a first side of the firebox toward a second side of the firebox opposite the first side of the firebox. The first side of the firebox is closer to the first side of the heating appliance than the second side of the firebox. The secondary air combustion path is configured to receive the combustion air from the combustion air intake and direct secondary combustion air of the first side of the firebox to the front of the firebox and into the firebox through the front of the firebox.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
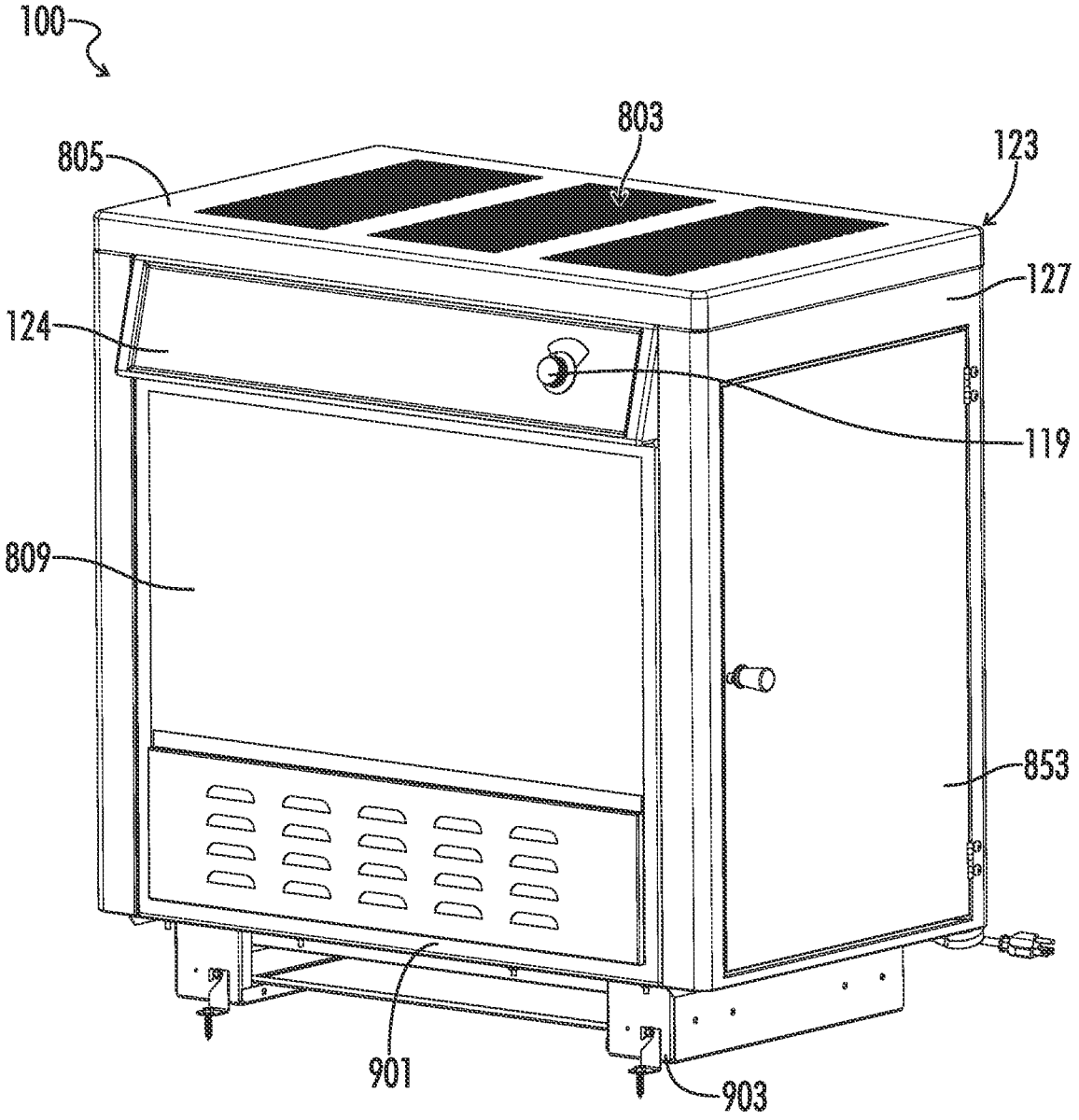
FIG. 1 is an isometric view of a cabinet circulator solid fuel burning heating appliance.
Figure 2:
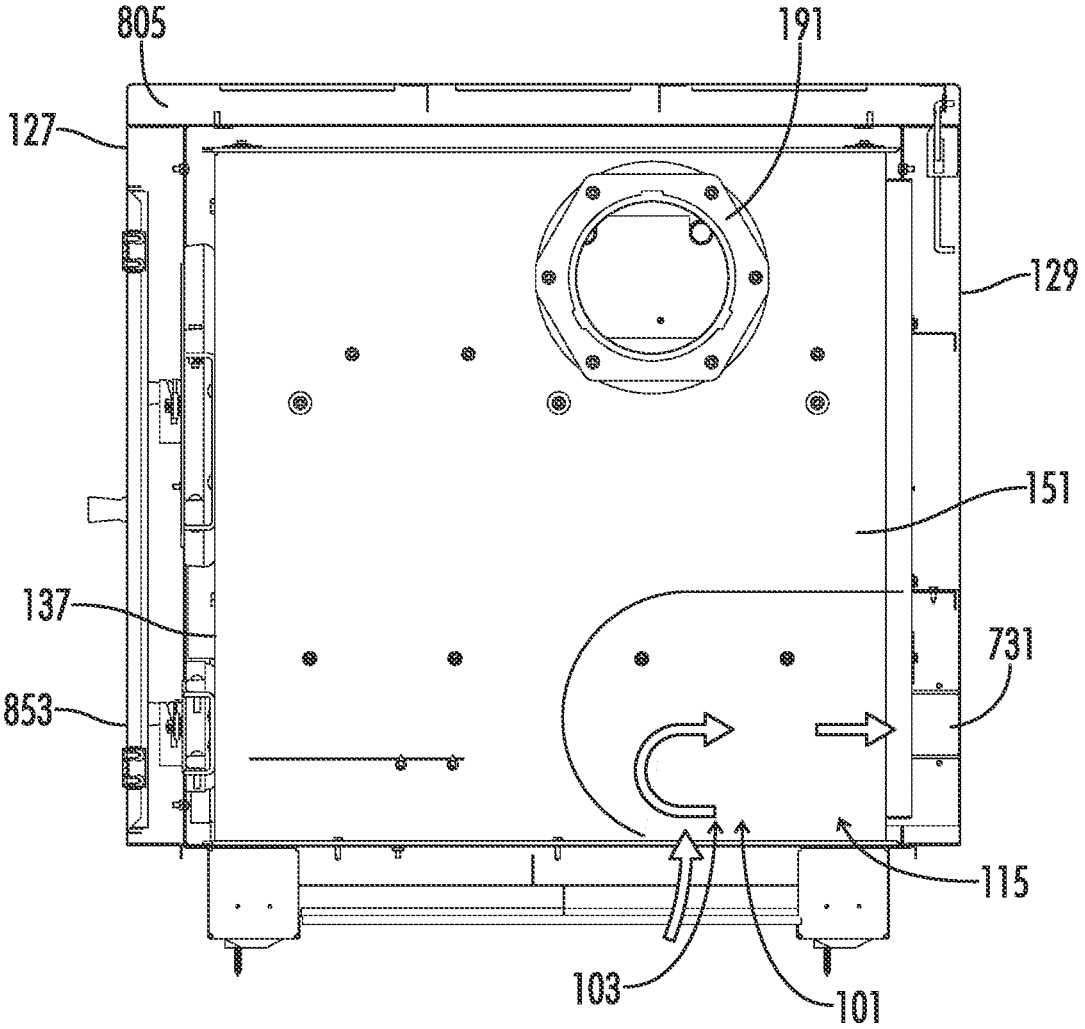
FIG. 2 is a rear cutaway view of the heating appliance of FIG. 1.
Figure 3:
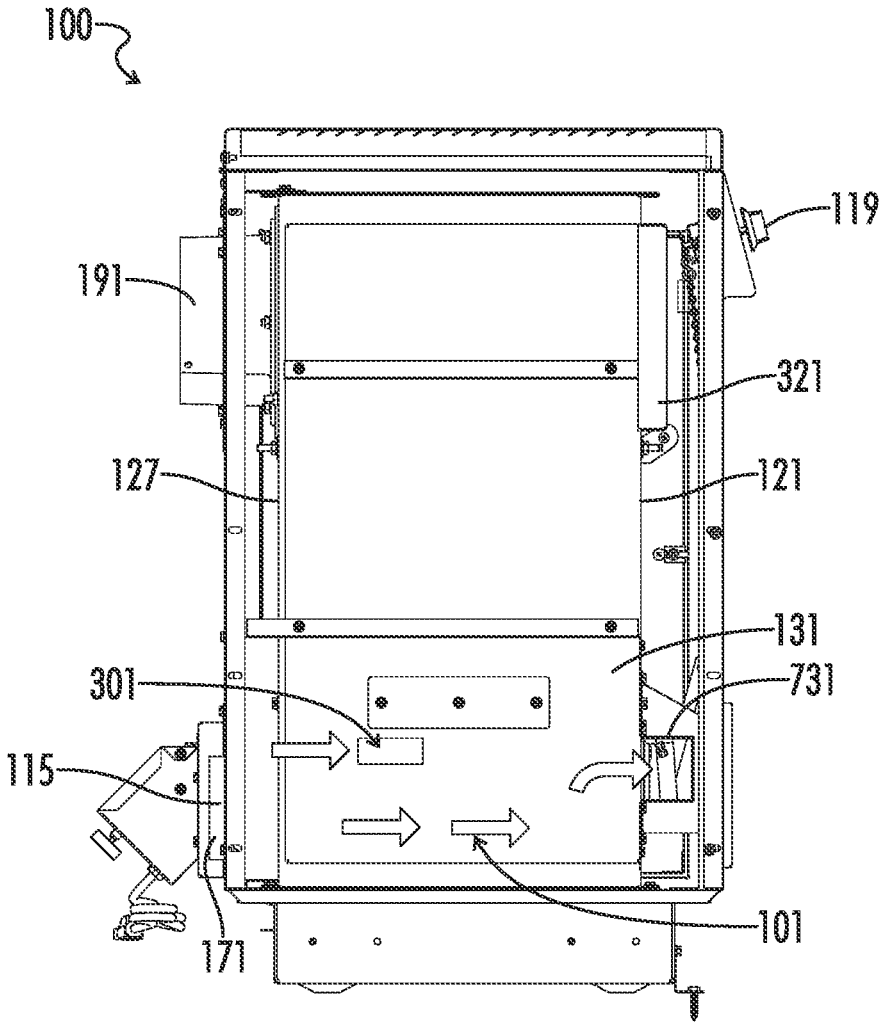
FIG. 3 is a left side cutaway view of the heating appliance of FIG. 1.
Figure 4:
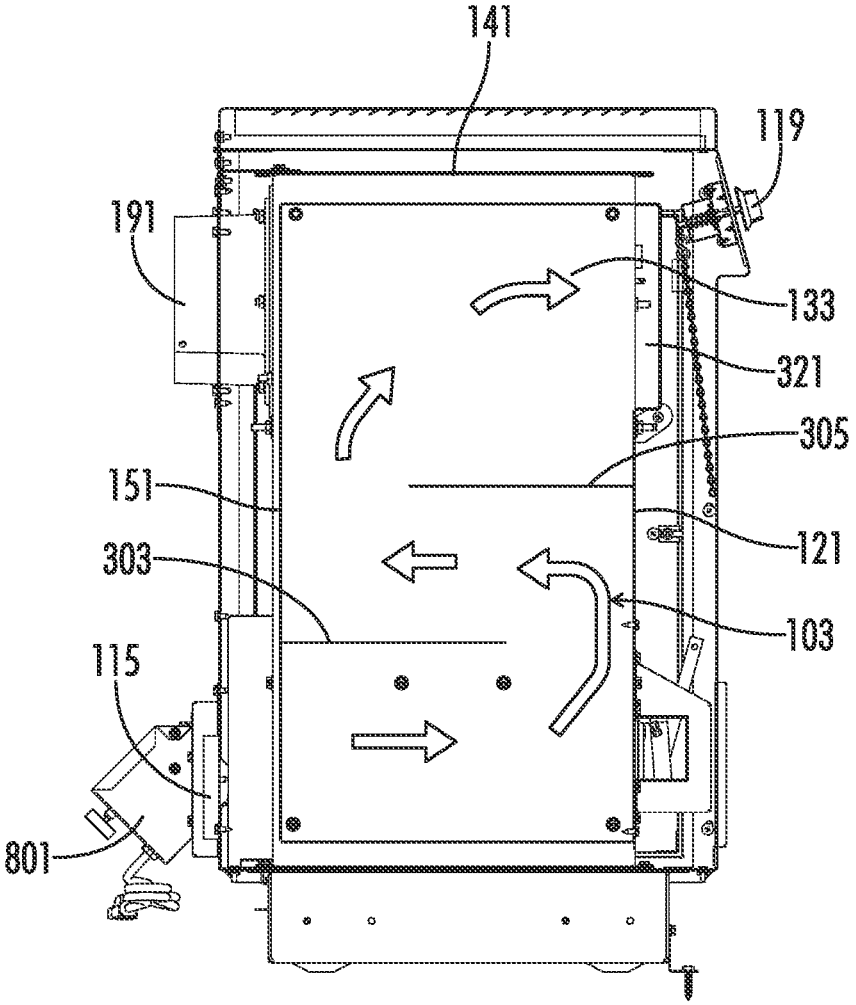
FIG. 4 is a left side cutaway view of the heating appliance of FIG. 1 showing the firebox.
Figure 5:
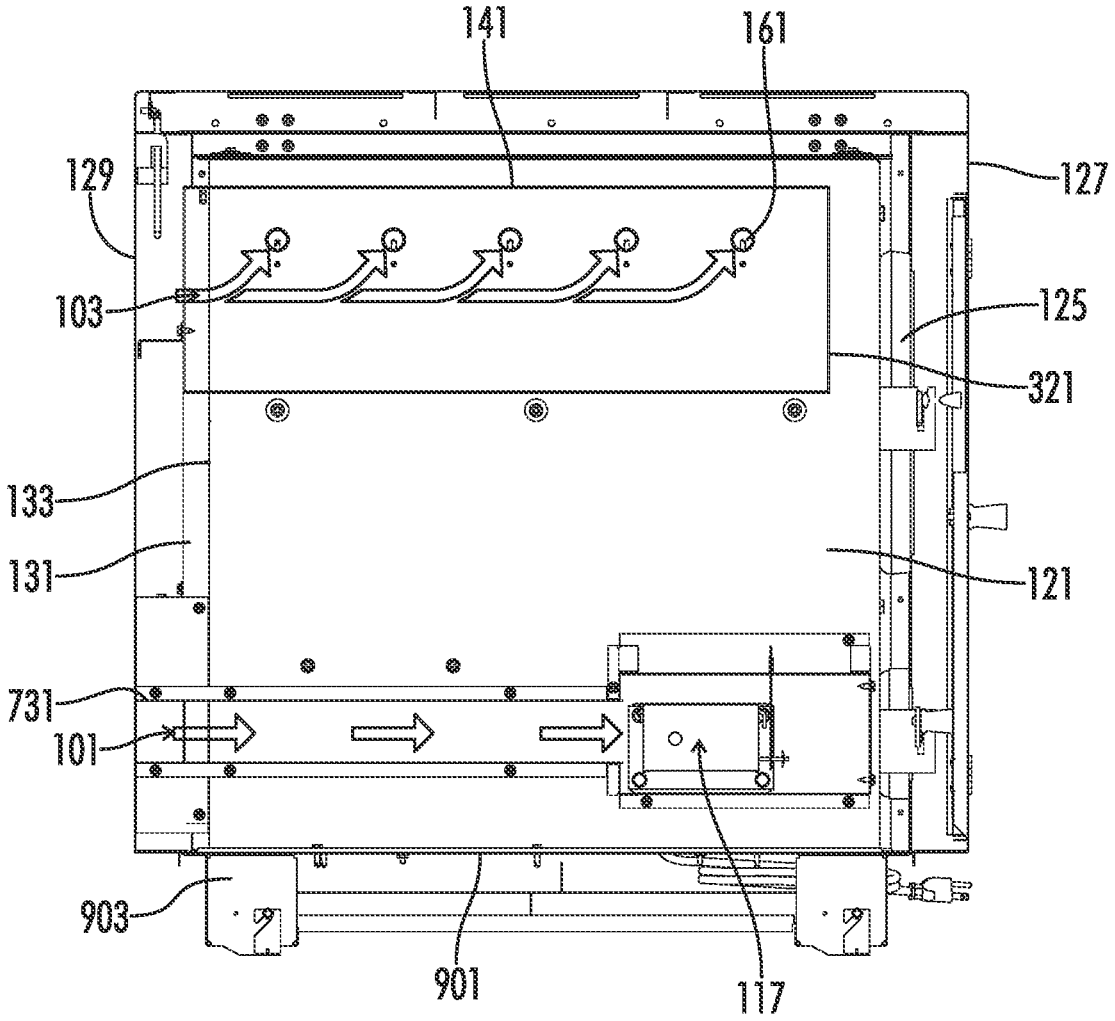
FIG. 5 is a front cutaway view of the heating appliance of FIG. 1.
Figure 6:
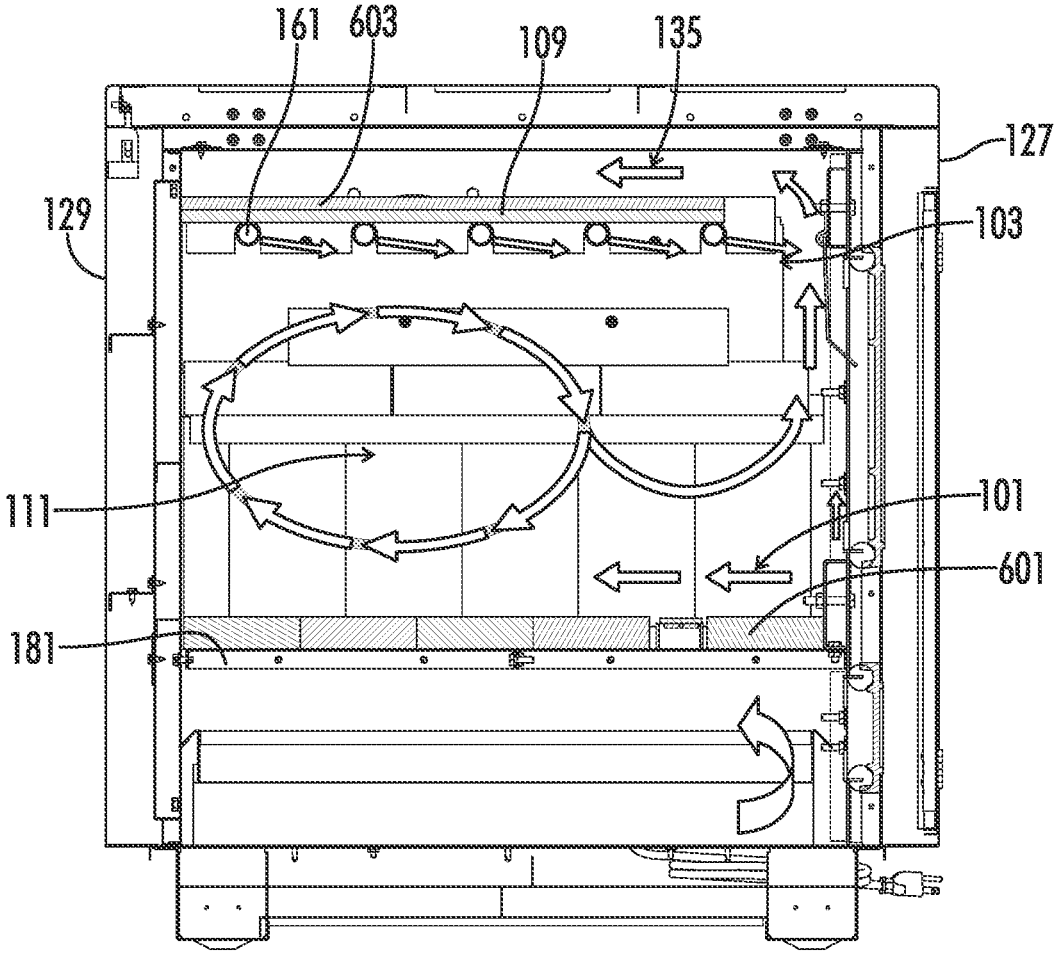
FIG. 6 is a front cutaway view of the heating appliance of FIG. 1 inside the firebox.
Figure 7:
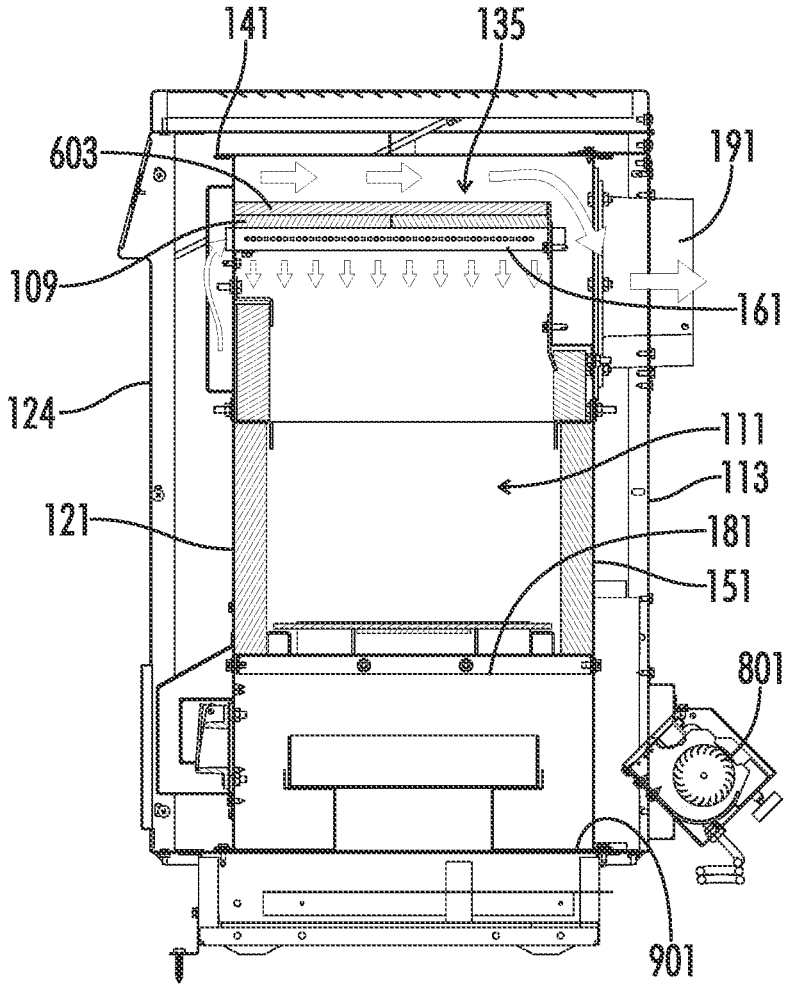
FIG. 7 is a right side cutaway view of the heating appliance of FIG. 1 showing the exhaust gas path.
Figure 8:
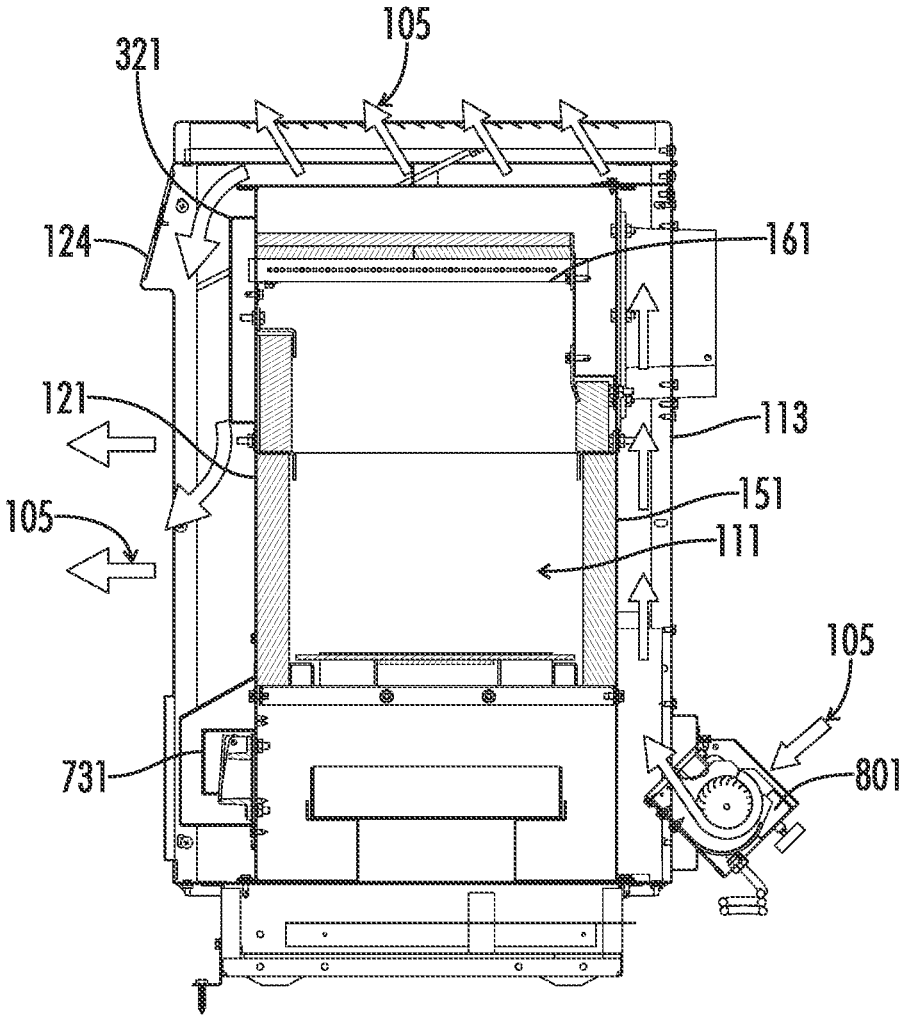
FIG. 8 is a right side cutaway view of the heating appliance of FIG. 1 showing the room air path.
Figure 9:
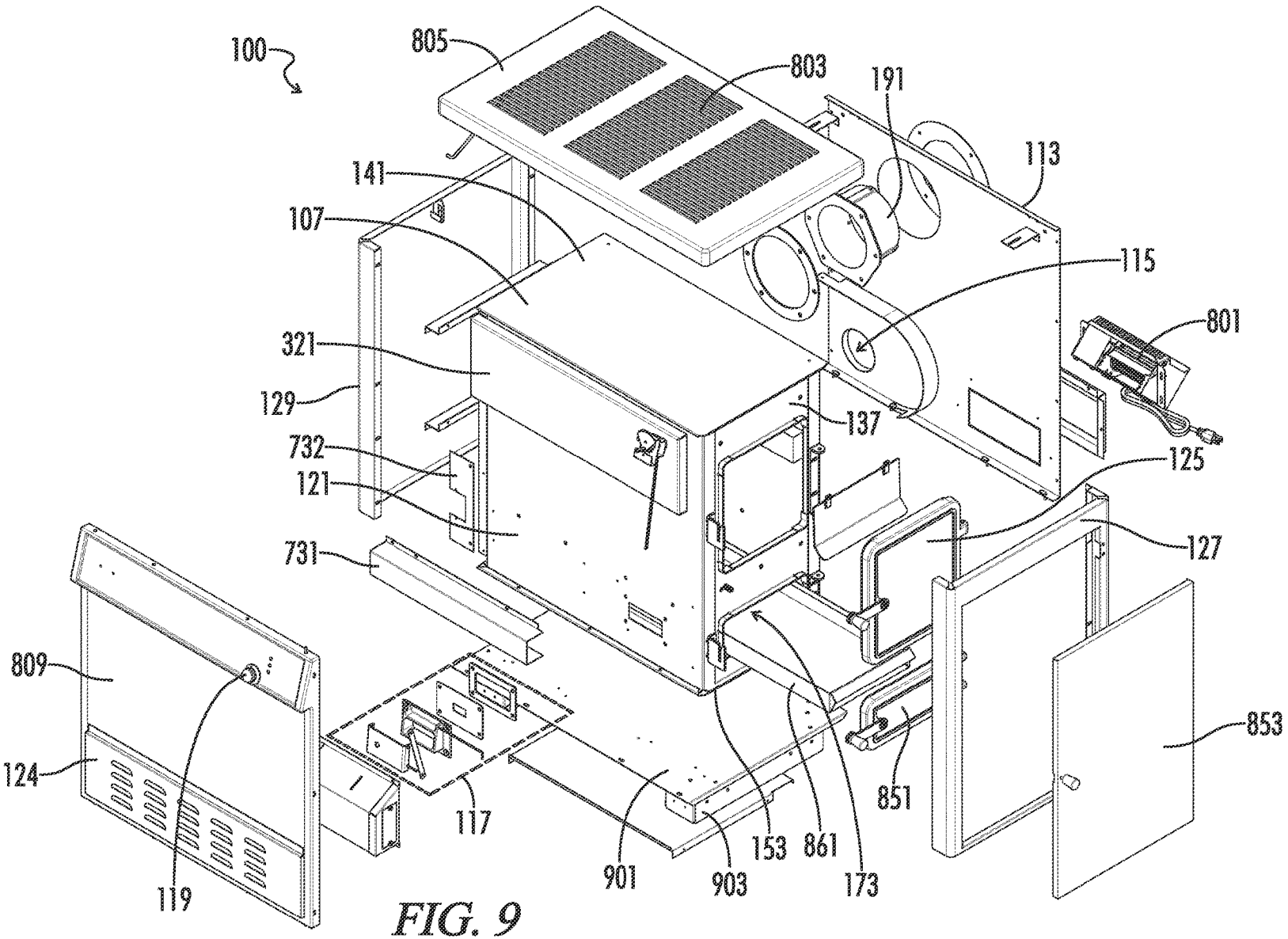
FIG. 9 is an exploded view of the heating appliance of FIG. 1.
Figure 10:
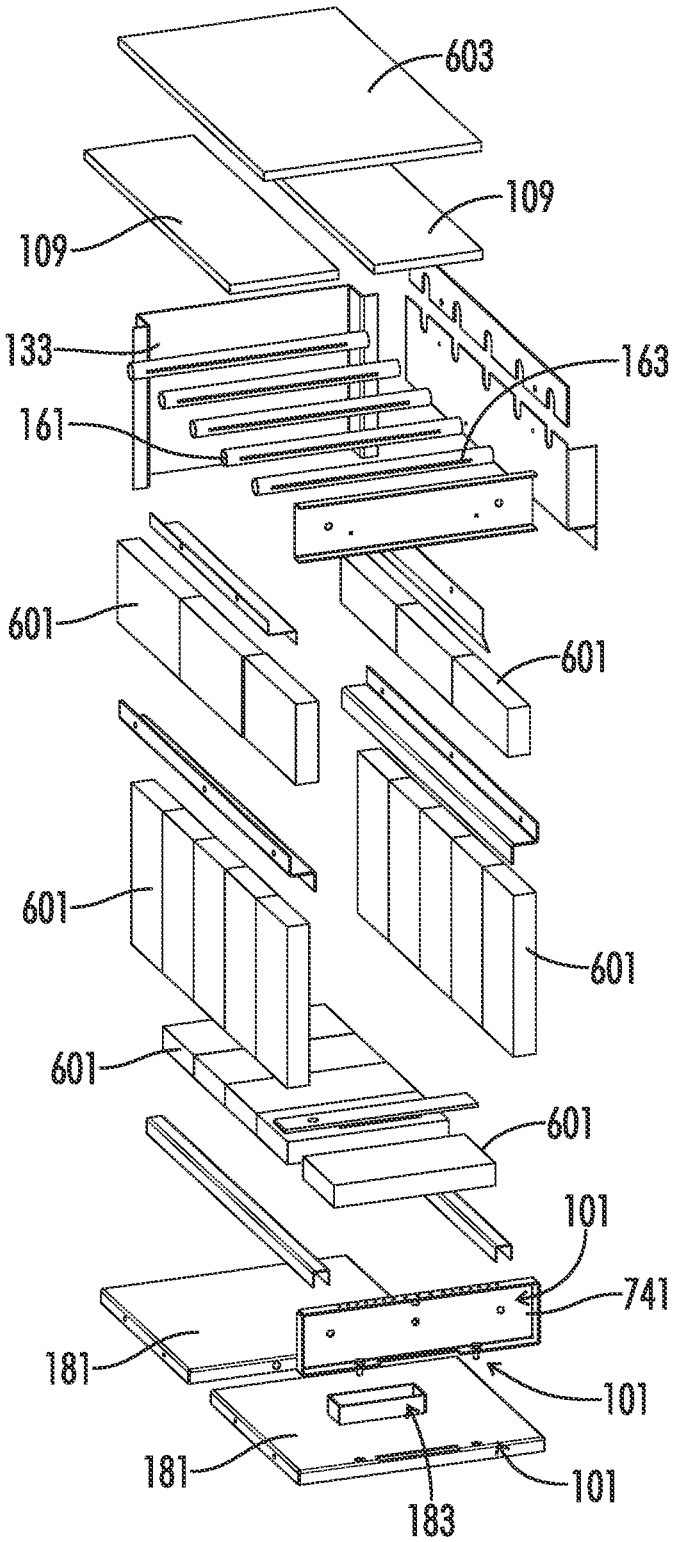
FIG. 10 is a partial exploded view of the heating appliance of FIG. 1.

As described herein, an upright position is considered to be the position of apparatus components while in proper operation or in a natural resting position as described herein. The upright position of a cabinet circulator solid fuel heater is sitting on a generally level floor as shown in FIG. 1. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring to FIGS. 1-10, in one embodiment, a cabinet circulator solid fuel heater 100 has a primary combustion air path 101, a secondary combustion air path 103, and a room air path 105. The primary and secondary combustion air streams are introduced into the heater firebox 107 through a series of manifolds along the firebox 107 exterior. These air streams are broken down into two types: primary and secondary combustion air streams. The primary air stream 101 modulates the intensity of the fire or overall burn rate of the heating appliance 100. The secondary combustion air stream 103 is injected above the solid fuel in the firebox 107, under a baffle 109 defining a top of the burn chamber 111 of the firebox 107 to combust unburned fuel and the particulate (smoke) in the burn chamber 111.

The primary air stream 101 enters the rear 113 of the heating appliance through a combustion air intake 115. This intake air stream is then heated as it travels forward along the lower edge of the firebox 107 until it reaches the primary air damper 117. The primary air damper 117 is actuated by a single control (e.g., a knob) 119 on the upper outside front 124 of the cabinet 123 so that the user can easily access the control for burn rate modulation. The primary combustion air 101 has two introduction streams entering the burn chamber 111 of the firebox 107 located near the fuel loading door 125 (e.g., at the right side 127 of the cabinet 123 or appliance 100).

The secondary air stream 103 enters the first side 129 of the appliance 100 from the combustion air intake 115 and travels through a manifold 131 up the first side and along the upper front 121 of the firebox 107. These secondary combustion air manifolds 131 are much larger than the primary air channels and located along the top of the firebox so as to heat the secondary air stream 103 to a much higher temperature than the primary air 101. The secondary air 103 is injected into the burn chamber 111 of the firebox 107 through a series of tubes 161 (e.g., secondary combustion tubes 161).

Combustion from both air streams occurs under the baffle 109. The baffle 109 is designed to allow exhaust gases 135 up and around the baffle edge at the loading door side (e.g., the second side 137) of the firebox 107. The exhaust gases 135 then move on to the rear of the firebox 107 where a flue collar 139 at the rear of the firebox 107 carries exhaust gases into the chimney system.

In one embodiment, the firebox 107 is lined with more firebrick (or ceramic) than conventional prior art, cabinet circulator solid fuel heaters. Areas of the firebox that are not lined with brick are used to preheat the primary and secondary combustion air 101, 103 in the air manifolds and channels. The double wall feature created by the manifolds acts as an insulator and maintains high internal firebox temperature to aid in the complete combustion of the fuel while the unlined portions of the firebox allow rapid heating of air exhausted by the heating appliance (i.e., the heating appliance has a faster initial heat rise than fully lined firebox solid fuel heating appliances). That is, the top 141 of the firebox 107 is unlined or uninsulated. The primary 101 and secondary 103 combustion air streams function in a specific balance under natural chimney draft to achieve desired emissions performance when burning sold fuels.

In one embodiment, a cabinet circulator solid fuel heating appliance 100 includes a firebox 107, a cabinet 123, a combustion air intake 115, a primary air combustion path 101, and a secondary air combustion path 103. The firebox 107 is configured to receive solid fuel and combust the solid fuel therein. The firebox 107 includes a front 121 (i.e., front side), a first side 133, a second side 137, a rear 151 (i.e., rear side), a top 141, and a bottom 153. In one embodiment, the firebox 107 further includes a baffle 109 extending from the first side 133 of the firebox 107 toward the second side 137 of the firebox 107. In one embodiment, the firebox 107 further includes a floor 181, an ash collector 173, a burn chamber 111, and exhaust path 135. The floor when a one is configured to support solid fuel during combustion of the solid fuel. The baffle 109 is above the floor 181 in space apart from the floor 181. The baffle 109 extends from the first side 133 of the firebox 107 toward the second side 137 of the firebox 107. The top 141 of the firebox 107 is above the baffle 109 and spaced apart from the baffle 109. The ash collector 173 is below the floor 181. The ash collector 173 is configured to receive ash through a cleanout port 183 in the floor 181 of the firebox 107. The burn chamber 111 is between the floor 181 of the firebox 107 and the baffle 109. The primary and secondary combustion of the solid fuel occurs in the burn chamber 111. The exhaust path 135 is configured to remove exhaust gases from the firebox 107 to a flue collar 191. The exhaust path 135 is formed between the baffle 109 and the second side 137 of the firebox 107 and between the baffle 109 and the top 141 of the firebox 107. Generally, the front of the exhaust path 135 and the rear of the exhaust path 135 are defined by the front side 121 and the rear side 151 of the firebox. The flue collar 191 is configured to attach to the rear 151 of the firebox 107. The rear 151 of the firebox has a hole therethrough corresponding to the flue collar 191 to allow exhaust gases into the flue collar 191, and the flue collar 191 extends through the rear side 113 of the cabinet 123 is configured to connect to a chimney or exhaust stack.

In one embodiment, the secondary air combustion path 103 includes a plurality of secondary air tubes 161 extending from the front 121 of the firebox 107 toward the rear 151 of the firebox 107 under the baffle 109. The secondary air combustion path 103 directs the secondary combustion air into the firebox 107 through the plurality of secondary air tubes 161 through holes 163 in the tubes. In one embodiment, the holes 163 in the tubes are configured to direct the secondary combustion air downward and toward the second side 137 of the firebox 107. For example, the holes 161 may be approximately 15 to 30° below horizontal when the appliances installed on a level surface.

In one embodiment, the combustion air intake 115 is formed through a back 113 of the cabinet 123 at the first side 129 of the back 113 (i.e., rear) at a bottom of the cabinet 123. In one embodiment, the combustion air intake 115 comprises a flange 171 configured to seal to a tube such that the appliance 100 may draw combustion air from outside a room in which the appliance is installed via the tube.

In one embodiment, the first side 133 of the firebox 107 includes a manifold 131 and a burn chamber wall 133. Manifold 131 includes an outer skin having a secondary air inlet 301 at a bottom rear corner of said outer skin 131. The manifold 131 includes a first guide 303 extending from the rear 151 of the firebox 107 forward toward the front 121 of the firebox 107 and between the burn chamber wall 133 and the outer skin 131 to direct the secondary combustion air 103 forward under the first guide 303. The first 303 does not extend to the front 121 of the firebox 107 such that the secondary combustion air 103 is able to move above the first guide 303 at a forward end of the first guide 303. The manifold 131 further includes a second guide 305 extending from the front 121 of the firebox 107 toward the rear 151 of the firebox 107 between the burn chamber wall 133 and the outer skin 131 2 direct secondary combustion air 103 rearward between the first guide 303 and the second guide 305. The second guide 305 does not extend to the rear 151 of the firebox 107 such that the secondary combustion air 103 is able to move above the second guide 305 at a rear end of the second guide 305 as the secondary combustion air 103 receives heat from the burn chamber 111 through the burn chamber wall 133. In one embodiment, the appliance 100 further includes a secondary air channel 321 extending along the front 121 of the firebox 107. The secondary air channel 321 is configured to receive the secondary combustion air 103 from above the second guide 305 and direct the secondary combustion air 103 to the burn chamber 111 of the firebox 107 through the front 121 of the firebox 107 via the plurality of secondary air tubes 161. In one embodiment, the majority of the first side 133 of the firebox is uninsulated such that heat from the burn chamber 111 of the firebox 107 is transferred into the secondary air path 103. As used herein, insulation may be fire brick 601, ceramics, fiberglass blanketing 603, or any other fire resistant insulation material. In one embodiment, the majority of the front 121 of the firebox 107 corresponding to the secondary air channel 321 is uninsulated such that heat from the burn chamber 111 of the firebox 107 is transferred into the secondary air path 103 through the front 121 of the firebox 107.

In one embodiment, the appliance 100 further includes a primary air channel 731 extending across the front 121 of the firebox 107 to form a portion of the primary air combustion path 101 and conduct primary combustion air from the first side 133 of the firebox 107 to a primary air inlet 741 at the floor 181 of the second side 137 of the firebox 107. In one embodiment, a majority of the front 121 of the firebox 107 corresponding to the primary air channel 731 is uninsulated.

In one embodiment, the appliance 100 further includes a room air fan 801 configured to cooperate with the cabinet 123 to force room air up the back or rear 151 of the firebox 107 and over the top 141 of the firebox 107 toward the front 121 of the firebox 17. The cabinet 123 includes a vent 803 on a top 805 of the cabinet 123 such that room air forced into the cabinet 123 by the room air fan 801 is heated by the firebox 107 and expelled from the cabinet 123 via the vent 803. In one embodiment, the cabinet 123 further includes a vent 809 in a front 124 of the cabinet 123 such that room air forced into the cabinet 123 by the room air fan 801 is heated by the firebox 107 expelled from the cabinet 123 via the vent 809. As used herein, vents 809 and 803 may be louvers, holes, screens, or any combination or equivalent thereof.

In one embodiment, a portion of a top 805 of the cabinet 123 is removal such that the top 141 of the firebox 107 is directly accessible to a user who has removed the removable portion of the top 805 of the cabinet 123. In one embodiment, the top (i.e., or a portion thereof) is hingedly attached to the back 113 of the cabinet 123 such that the top 805 of the cabinet 123 may be lifted at a front of the top 805 of the cabinet 123 and propped in an up position to allow access to the top 141 of the firebox 107.

In one embodiment, the cabinet 123 further includes an access hatch 853 in the second side 127 of the cabinet 123 corresponding to the second side 137 of the firebox 107. The appliance 100 further includes an ash door 851 forming a portion of the second side 137 of the firebox 107. The appliance 100 further includes an ashtray 861 configured to reside in the ash collector 173. The ashtray 861 is removable from the firebox 107 in cabinet 123 via the ash door 851 and the access hatch 853. In one embodiment, a fuel door 125 forms a portion of the second side 137 of firebox 107. The fuel door 125 is configured to allow access to the burn chamber 111 from outside the appliance 100 when the fuel door 125 and access hatch 853 are both open. In one embodiment, the access hatch 853 is a hinged door.

In one embodiment, the burn chamber 111 is insulated on the front side of the burn chamber 111, a rear side of the burn chamber 111, and a floor 181 of the burn chamber 111. The burn chamber 111 is not insulated on a first side of the burn chamber 133 corresponding to the first side of the cabinet 129 or appliance 100. In one embodiment, the firebox 107 further includes an insulating blanket 603 located on top of the baffle 109 when the appliance 100 is properly assembled such that a top of the burn chamber 111 (i.e., baffle 109) is insulated by the insulating blanket 603.

In one embodiment, the cabinet 123 includes a floor 901 under a bottom of the ash collector 173 of the firebox 107. In one embodiment, the appliance 100 further includes a riser 8903 configured to support the cabinet floor 901 above a surface upon which the appliance 100 is installed. In one embodiment, the bottom 901 of the cabinet 123 and the bottom of the firebox 107 are integral with one another.

In one embodiment, the first side 133 of the firebox 107 includes a manifold 131 and a burn chamber wall 133. The manifold 131 includes a first guide 303 and the second guide 305. The first guide extends from the rear 151 of the firebox 107 forward toward the front 121 of the firebox 107 and between the burn chamber wall 133 and the first side 129 of the cabinet 123 2 direct the secondary combustion air 103 forward under the first guide 303. The first guide 303 does not extend to the front 121 of the firebox 107 such that the secondary combustion air 103 is able to move above the first guide 303 at a forward end of the first scout 303. Primary combustion air 103 is drawn into primary combustion air channel 731 from below the first guide 303 (see, for example, FIG. 9 and block off plate 732). A second guide 305 extends from the front 121 of the firebox 107 toward the rear 151 of the firebox 107 between the burn chamber wall 133 and the first side 129 of the cabinet 123 2 direct secondary combustion air rearward between the first guide 303 and the second guide 305. The second guide 305 does not extend to the rear 151 of the firebox 107 such that the secondary combustion air 103 is able to move above the second guide 305 at a rear end of the second guide 305. The secondary air channel 321 receives the secondary combustion air 103 from above the second guide 305 and directs the secondary combustion air 103 to the burn chamber 111 of the firebox 107 through the front 121 of the firebox 107 via the plurality of secondary air tubes 161.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful CABINET CIRCULATOR SOLID FUEL HEATER COMBUSTION SYSTEM it is not intended that such references be construed as limitations upon the scope of this invention except as set forth in the following claims.

What is claimed is:

1. A cabinet circulator solid fuel heating appliance comprising:

a firebox configured to receive solid fuel and combust the solid fuel therein;

a cabinet surrounding the firebox on at least five sides of the firebox;

a combustion air intake configured to receive combustion air at a first side of the heating appliance;

a primary air combustion path configured to receive the combustion air from the combustion air intake and direct primary combustion air toward a front of the heating appliance and across a front of the firebox from a first side of the firebox toward a second side of the firebox opposite the first side of the firebox, through an air damper, and into the firebox at the second side of the firebox opposite the first side of the firebox, wherein the first side of the firebox is closer to the first side of the heating appliance than the second side of the firebox; and a secondary air combustion path configured to receive the combustion air from the combustion air intake and direct secondary combustion air up the first side of the firebox to the front of the firebox and into the firebox through the front of the firebox.

2. The heating appliance of claim 1, wherein:

the firebox comprises a baffle extending from the first side of the firebox toward the second side of the firebox;

the secondary air combustion path comprises a plurality of secondary air tubes extending from the front of the firebox toward a rear of the firebox under the baffle; and the secondary air combustion path directs the secondary combustion air into the firebox through the plurality of secondary air tubes through holes in the tubes.

3. The heating appliance of claim 1, wherein:

the firebox comprises a baffle extending from the first side of the firebox toward the second side of the firebox;

the secondary air combustion path comprises a plurality of secondary air tubes extending from the front of the firebox toward a rear of the firebox under the baffle;

the secondary air combustion path directs the secondary combustion air into the firebox through the plurality of secondary air tubes through holes in the tubes; and the holes in the tubes are configured to direct the secondary combustion air down and toward the second side of the firebox.

4. The heating appliance of claim 1, wherein:

the combustion air intake is formed through a back of the cabinet of the heating appliance at the first side of the back at a bottom of the cabinet.

5. The heating appliance of claim 1, wherein:

the combustion air intake comprises a flange configured to seal to a tube such that the heating appliance may draw combustion air from outside a room in which the heating appliance is installed via the tube.

6. The heating appliance of claim 1, wherein the firebox comprises:

a floor configured to support a solid fuel during combustion of the solid fuel;

a baffle above the floor and spaced apart from the floor, said baffle extending from the first side of the firebox toward the second side of the firebox;

a top above the baffle and spaced apart from the baffle;

an ash collector below the floor, said ash collector configured to receive ash through a cleanout port in the floor of the firebox;

a burn chamber between the floor of the firebox and the baffle, wherein primary and secondary combustion of the solid fuel occurs in the burn chamber; and an exhaust path configured to remove exhaust gases from the firebox to a flue collar, said exhaust path formed between the baffle and the second side of the firebox and between the baffle and the top of the firebox, wherein:

the flue collar is configured to attach to a rear of the firebox;

the rear of the firebox has a hole therethrough corresponding to the flue collar to allow exhaust gases into the flue collar; and the flue collar extends through a rear side of the cabinet and is configured to connect to a chimney or exhaust stack.

7. The heating appliance of claim 1, wherein:

the first side of the firebox comprises a manifold and a burn chamber wall;

the manifold comprises an outer skin having a secondary air inlet at a bottom rear corner of said outer skin;

the manifold comprises a first guide extending from the rear of the firebox forward toward the front of the firebox and between the burn chamber wall and the outer skin to direct the secondary combustion air forward under the first guide, wherein the first guide does not extend to the front of the firebox such that the secondary combustion air is able to move above the first guide at a forward end of the first guide;

the manifold comprises a second guide extending from the from the front of the firebox toward a rear of the firebox between the burn chamber wall and the outer skin to direct secondary combustion air rearward between the first guide and the second guide, wherein the second guide does not extend to the rear of the firebox such that the secondary combustion air is able to move above the second guide at a rear end of the second guide;

the heating appliance further comprises a secondary air channel extending along the front of the firebox, said secondary air channel configured to receive the secondary combustion air from above the second guide and direct the secondary combustion air to a burn chamber of the firebox through the front of the firebox via a plurality of secondary air tubes;

a majority of the first side of the firebox is uninsulated such that heat from the burn chamber of the firebox is transferred into the secondary air path; and a majority of the front of the firebox corresponding to the secondary air channel is uninsulated such that heat from the burn chamber of the firebox is transferred into the secondary air path through the front of the firebox.

8. The heating appliance of claim 1, wherein:

the first side of the firebox comprises a manifold and a burn chamber wall;

the manifold comprises a first guide extending from the rear of the firebox forward toward the front of the firebox and between the burn chamber wall and the first side of the cabinet to direct the secondary combustion air forward under the first guide, wherein the first guide does not extend to the front of the firebox such that the secondary combustion air is able to move above the first guide at a forward end of the first guide;

the manifold comprises a second guide extending from the front of the firebox toward a rear of the firebox between the burn chamber wall and the first side of the cabinet to direct secondary combustion air rearward between the first guide and the second guide, wherein the second guide does not extend to the rear of the firebox such that the secondary combustion air is able to move above the second guide at a rear end of the second guide;

the heating appliance further comprises a secondary air channel extending along the front of the firebox, said secondary air channel configured to receive the secondary combustion air from above the second guide and direct the secondary combustion air to a burn chamber of the firebox through the front of the firebox via a plurality of secondary air tubes;

a majority of the first side of the firebox is uninsulated such that heat from the burn chamber of the firebox is transferred into the secondary air path; and a majority of the front of the firebox is uninsulated such that heat from the burn chamber of the firebox is transferred into the secondary air path through the front of the firebox.

9. The heating appliance of claim 1, wherein:

the heating appliance further comprises a primary air channel extending across the front of the firebox to form a portion of the primary air combustion path and conduct primary combustion air from the first side of the firebox to the a primary air inlet at a floor of the second side of the firebox, wherein a majority of the front of the firebox corresponding to the primary air channel is uninsulated.

10. The heating appliance of claim 1, wherein:

the heating appliance further comprises a room air fan configured to cooperate with the cabinet to force room air up a back of the firebox and over a top of the firebox toward a front of the firebox, wherein the cabinet comprises a vent on a top of the cabinet such that room air forced into the cabinet by the room air fan is heated by the firebox and expelled from the cabinet via the vent.

11. The heating appliance of claim 1, wherein:

the heating appliance further comprises a room air fan configured to cooperate with the cabinet to force room air up a back of the firebox, over a top of the firebox toward a front of the firebox, and down a front of the firebox, wherein the cabinet comprises a vent on a front of the cabinet such that room air forced into the cabinet by the room air fan is heated by the firebox and expelled from the cabinet via the vent.

12. The heating appliance of claim 1, wherein:

the heating appliance further comprises a room air fan configured to cooperate with the cabinet to force room air up a back of the firebox, over a top of the firebox toward a front of the firebox, and down a front of the firebox, wherein the cabinet comprises a vent on a front of the cabinet such that room air forced into the cabinet by the room air fan is heated by the firebox and expelled from the cabinet via the vent; and the vent is a screen.

13. The heating appliance of claim 1, wherein:

a portion of a top of the cabinet is removable such that a top of the firebox is directly accessible to a user who has removed the portion of the top of the cabinet.

14. The heating appliance of claim 1, wherein:

a top of the cabinet is hingedly attached to a back of the cabinet such that the top of the cabinet may be lifted at a front of the top of the cabinet and propped in an up position to allow access to a top of the firebox.

15. The heating appliance of claim 1, wherein:

the heating appliance further comprises a burn rate controller configured to adjust a flow rate of primary combustion airflow into the firebox in response to input from a user, wherein the burn rate controller is a knob configured to adjust the air damper through which primary combustion air enters into the firebox.

16. The heating appliance of claim 1, wherein:

the cabinet comprises an access hatch in a second side of the cabinet corresponding to the second side of the firebox; and the firebox comprises:

a floor configured to support a solid fuel during combustion of the solid fuel;

a baffle above the floor and spaced apart from the floor, said baffle extending from the first side of the firebox toward the second side of the firebox;

a top above the baffle and spaced apart from the baffle;

an ash collector below the floor, said ash collector configured to receive ash through a cleanout port in the floor of the firebox;

a burn chamber between the floor of the firebox and the baffle, wherein primary and secondary combustion of the solid fuel occurs in the burn chamber;

an exhaust path configured to remove exhaust gases from the firebox to a flue collar, said exhaust path formed between the baffle and the second side of the firebox and between the baffle and the top of the firebox;

an ash door forming a portion of the second side of the firebox; and an ash tray configured to reside in the ash collector, wherein said ash tray is removable from the firebox and cabinet via the ash door and the access hatch in the second side of the cabinet.

17. The heating appliance of claim 1, wherein:

the cabinet comprises an access hatch in a second side of the cabinet corresponding to the second side of the firebox; and the firebox comprises:

a floor configured to support a solid fuel during combustion of the solid fuel;

a baffle above the floor and spaced apart from the floor, said baffle extending from the first side of the firebox toward the second side of the firebox;

a top above the baffle and spaced apart from the baffle;

an ash collector below the floor, said ash collector configured to receive ash through a cleanout port in the floor of the firebox;

a burn chamber between the floor of the firebox and the baffle, wherein primary and secondary combustion of the solid fuel occurs in the burn chamber;

an exhaust path configured to remove exhaust gases from the firebox to a flue collar, said exhaust path formed between the baffle and the second side of the firebox and between the baffle and the top of the firebox; and a fuel door forming a portion of the second side of the firebox, wherein said fuel door is configured to allow access to the burn chamber from outside the heating appliance when the fuel door and access hatch are both open.

18. The heating appliance of claim 1, wherein:

the firebox comprises:

a floor configured to support a solid fuel during combustion of the solid fuel;

a baffle above the floor and spaced apart from the floor, said baffle extending from the first side of the firebox toward the second side of the firebox;

a top above the baffle and spaced apart from the baffle;

an ash collector below the floor, said ash collector configured to receive ash through a cleanout port in the floor of the firebox; and a burn chamber between the floor of the firebox and the baffle; wherein:

primary and secondary combustion of the solid fuel occurs in the burn chamber;

the burn chamber is insulated by firebrick on a front side of the burn chamber, a rear side of the burn chamber, and a floor of the burn chamber;

the burn chamber is not insulated on a first side of the burn chamber corresponding to the first side of the heating appliance; and the firebox further comprises an insulating blanket located on top of the baffle when the heating appliance is properly assembled such that a top of the burn chamber is insulated by the insulating blanket.

19. The heating appliance of claim 1, wherein:

the cabinet comprises a floor under a bottom of an ash collector of the firebox, said floor connecting the front side, rear side, first side, and second side of the cabinet when the heating appliance is assembled; and the heating appliance further comprises a riser or feet configured to support the floor above a surface upon which the heating appliance is installed.

* * * * *